United States Patent [19]

Mollerstedt

[11] 4,006,497

[45] Feb. 8, 1977

[54] APPARATUSES FOR DISTRIBUTING FLUSHING LIQUID IN CLOSET PANS

[75] Inventor: Karl Allan Bonde Mollerstedt, Fjalkinge, Sweden

[73] Assignee: IFO AB, Bromolla, Sweden

[22] Filed: July 3, 1975

[21] Appl. No.: 592,794

[30] Foreign Application Priority Data

July 4, 1974 Sweden ..... 7408810

[52] U.S. Cl. ..... 4/1; 4/69 R; 4/89

[51] Int. Cl.[2] ..... A47K 17/00

[58] Field of Search ..... 4/1, 69, 89, 195, 9, 4/68, 10, 76, 191, 192, 262; 425/388; 264/92

[56] References Cited

UNITED STATES PATENTS

| | | | |
|---|---|---|---|
| 268,740 | 12/1882 | Smith | 4/89 |
| 571,244 | 11/1896 | Reed | 4/89 |
| 2,164,319 | 7/1939 | Groeniger | 4/69 |
| 2,672,619 | 3/1954 | Grant | 4/89 X |
| 3,212,106 | 10/1965 | Noel | 4/69 |
| 3,411,162 | 11/1968 | Palmer | 4/89 |
| 3,488,414 | 1/1970 | Naples | 425/388 |
| 3,528,865 | 9/1970 | Amberg et al. | 264/92 |
| 3,835,477 | 9/1974 | Moller | 4/9 |

FOREIGN PATENTS OR APPLICATIONS

| | | | |
|---|---|---|---|
| 425,668 | 6/1967 | Sweden | 4/10 |

*Primary Examiner*—Henry K. Artis
*Attorney, Agent, or Firm*—Karl W. Flocks

[57] ABSTRACT

An apparatus of an elastic material is intended to be placed along the upper edge of a closet pan for more effective distribution of the flushing liquid as it flows from the flushing liquid container to the pan. The apparatus has a longitudinal channel with a row of outlet openings which are directed towards the inner wall of the closet pan, and a slot along the row of openings which is normally closed because of the inherent elasticity of the material, but in which a tool may be inserted and pulled the length of the slot and row of openings for cleaning the channel and the openings.

4 Claims, 4 Drawing Figures

APPARATUSES FOR DISTRIBUTING FLUSHING LIQUID IN CLOSET PANS

The present invention relates to an apparatus for distributing flushing liquid in a closet pan, comprising a separate annular or horseshoe-shaped member to be placed along the upper edge of the closet pan, the member having a longitudinal channel with openings directed towards the inner wall of the closet pan and being connected to a supply of flushing liquid by the intermediary of a valve.

Normally, a closet pan is supplied with flushing liquid through a flushing rim extending about the upper edge of the closet pan and formed integrally with the closet pan, but it is also known to provide a flushing channel in a separate annular or horseshoe-shaped member which is disposed in association with the upper edge of the closet pan and which has openings or nozzles directed towards the inner wall of the closet pan. There are advantages in providing a separate member with a flushing channel in the closet pan since the production of the closet pan can be simplified and made less expensive by dispensing with the flushing rim which is complicated to manufacture. However, prior art separate members with flushing channels also have disadvantages, namely first and foremost the risk that the discharge openings or nozzles for the flushing liquid may become blocked and secondly the difficulty of mounting the member in such a way that dirt traps are not formed.

The object of the present invention is to obviate the disadvantages associated with prior art flushing inserts for closet pans and to provide an extremely simple member of this type which can be easily cleaned.

According to the invention, the channel in the separate annular or horseshoe-shaped member is wholly or partly defined by a wall of elastic material, for example plastic or rubber, the wall having a slot along the row of openings for the discharge of flushing liquid, the slot being closed in the normal position because of the inherent elasticity of the material but permitting the insertion of a tool, for example, a knife which may be pulled along the entire length of the slot for cleaning the channel and the openings.

Figure 1:
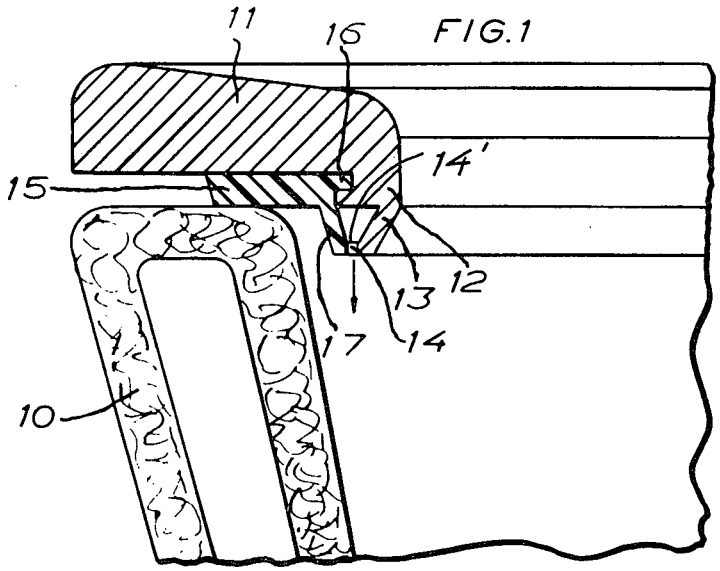
Figure 2:
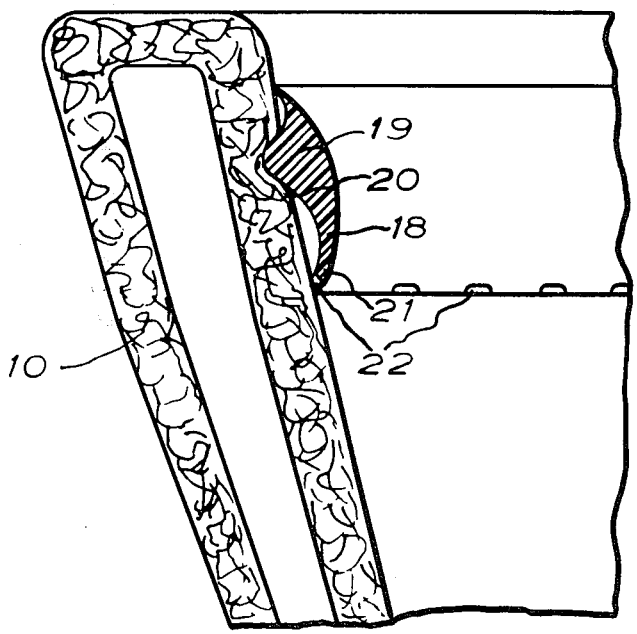
Figure 3:
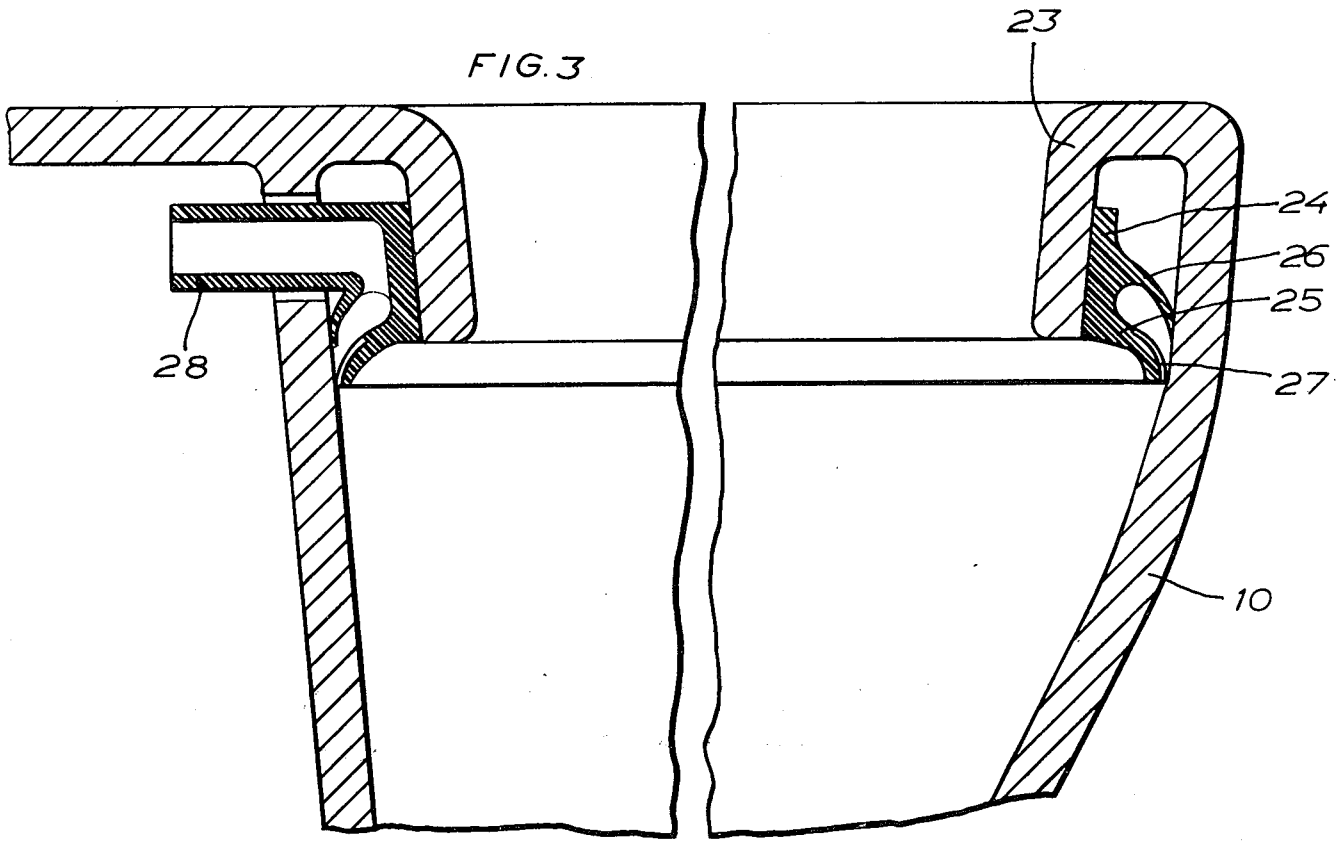
Figure 4:
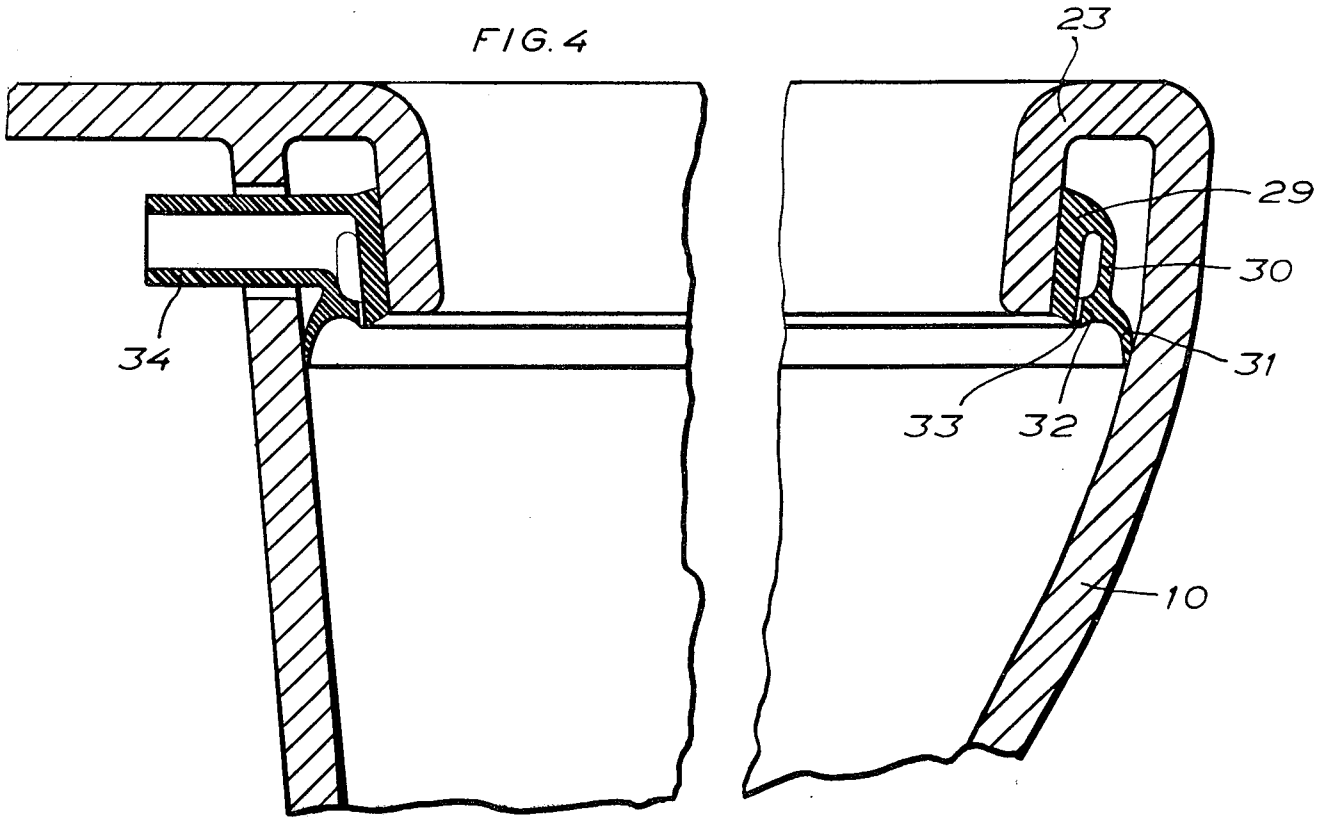

Embodiments of the invention will be described in greater detail hereinbelow and with reference to the accompanying drawings on which;

FIG. 1 is a section of a part of a closet pan with a seat placed thereon;

FIG. 2 likewise is a section of a part of a closet pan with an apparatus for distributing flushing liquid placed on the inside of the pan; and FIGS. 3 and 4 are sections showing modified embodiments of the apparatus according to the invention.

In FIG. 1, 10 designates a closet pan, of which only a part is shown. A seat 11 is placed on the closet pan, the seat having, within the upper edge of the closet pan, a downwardly directed portion 12 merging into a flange 13 which is directed obliquely towards the inner surface of the closet pan 10 and has a terminal edge angularly bent from said flange and formed with recesses 14. A profile 15 of elastic material, preferably rubber or plastic, is fixed at the underside of the seat 11 by means of a lug 16 which projects into a recess formed in the outwardly facing side of the downwardly directed portion 12. The profile 15 has an obliquely inwardly and downwardly directed linguiform member 17, the lower end of which abuts against the angularly bent terminal end of the flange 13. A slot 14′ is formed between the lower end of the flange 13 and the lower end of the linguiform member 17 in abutment therewith connecting recesses 14 shown, but the member 17 is urged by the inherent elasticity of the material against the lower end of the flange 13 such that this slot 14′ is closed in the normal position while the recesses 14 in the end of the flange 13 are kept open to form flushing liquid discharge openings.

The channel defined by the downwardly directed portion 12, the flange 13 and the linguiform member 17 is connected by the intermediary of a valve (not shown) to a supply of flushing liquid (not shown). When the valve is opened, flushing liquid will flow into the channel and through the recesses 14 down into the closet pan 10, as shown by means of an arrow, for cleaning the pan and removal of waste matter located in the pan. If any of the recesses 14 become blocked, it is easy to insert a tool, suitably a knife, into the channel through the slot between the end of the flange 13 and the linguiform member 17 because of the inherent elasticity of the latter, and pull the tool along the row of recesses thereby to remove matter blocking the recesses 14.

It is also apparent from FIG. 1 that a portion of the profile 15 may be used as an intermediate layer between the seat 11 and the upper boundary surface of the closet pan 10.

FIG. 2 illustrates another embodiment of the invention. The annular flushing liquid distribution member 18 extending along the inner side of the closet pan 10 is semilunar in cross-section and has a portion 19 projecting from the concave side of the member 18 facing the wall of the closet pan 10, the projecting portion being fixed, for example, by adhesive bonding, in a groove 20 formed in the inside of the closet pan wall and extending wholly or partly about the closet pan wall. The annular member 18 is, in this case, dimensioned such that its ends, as is apparent from FIG. 2, are brought into tight abutment against the inside of the closet pan wall 10. Recesses 22 are provided in the lower end 21 of the annular member 18 such that flushing liquid supplied to the channel defined by the member 18 and the inside of the closet pan can flow down into the closet pan for cleaning purposes. If the recesses 22 become blocked, the channel and the recesses are cleaned in the same way as has been described earlier, i.e. by forcing a tool in between the inside of the closet pan and the lower end 21 of the member 18, this being possible because of the elasticity of the member 18.

FIG. 3 illustrates a modified embodiment of the flushing liquid distributing member. In this embodiment, the closet pan 10 has been provided with a flushing rim 23 with a straight inner wall, an annular member 24 being fixed on the side of the rim facing the wall of the closet pan; the fixation is effected, for example, by adhesive bonding. The member 24 for distributing the flushing liquid has two projecting lips 25, 26 which abut against the inwardly facing wall surface of the closet pan and define, together with this wall surface, the flushing liquid channel. If desired, the lip 26 may be dispensed with. As in the embodiment according to FIG. 2, the lip 25 has recesses 27 for discharging the flushing liquid. A connecting socket 28 is also provided and is in communication with the above-mentioned channel.

The flushing liquid distributing member 29 according to FIG. 4 is also annular in form and has a body portion with a bent flange 30 which branches into two portions 31 and 32 of which the flange portion 32 abuts against the body portion and, together with it, defines the channel for the flushing liquid, while the flange portion 31 abuts against the inside of the closet pan to prevent the intrusion of dirt into the space above the member 29 defined by the rim. The flange portion 32 abutting against the body portion is formed with recesses 33 in its surface abutting against the body portion in the same manner as in the previously described embodiments. The flushing liquid channel in this embodiment is also in communication with a connecting socket 34.

The flushing liquid distribution members 24 and 29 are also made of a suitably elastic material and the flushing liquid channel and discharge recesses may be cleaned in the same simple manner as was earlier described.

As will be apparent from the above, the present invention provides a very simple and inexpensive apparatus for distributing flushing liquid in a closet pan. Moreover, the apparatus according to the present invention may be cleaned in a very simple manner by means of, for example, a knife and consequently does not serve as a dirt trap. The apparatus according to the present invention may be modified in a number of ways without departing from the spirit and scope of the appended claims and the above description should not, therefore, be considered as limitative of the scope of the invention.

What I claim and desire to secure by letters patent is:

1. An apparatus for distributing flushing liquid in a closet pan, comprising a separate member extending along at least the greater part of the upper edge of said closet pan and having a longitudinal channel with a row of openings which are directed towards the inner wall of said closet pan, said channel being connected to a supply of flushing liquid, a valve means between said supply of flushing liquid and said channel, said channel being defined by a wall of elastic material, said wall having a slot along said row of openings for the discharge of flushing liquid, said slot being closed in the normal position because of the inherent elasticity of the material but permitting the insertion of a tool which may be pulled along the entire length of said slot for cleaning said channel and said openings.

2. An apparatus as claimed in claim 1, wherein the channel of said separate member is defined by a portion of the seat of said closet projecting downwardly into said closet pan, a linguiform member abutting against the lower end of said downwardly projecting closet seat portion, said linguiform member being formed on a profile of elastic material fixed at the underside of said seat, said profile serving, at the same time, as an intermediate layer between the underside of said seat and the upper boundary surface of said closet pan.

3. An apparatus as claimed in claim 1, wherein said separate member comprises a profile of semilunar cross-section with recesses in its lower terminal edge, a portion projecting from the concave side of said member being arranged to be fixed in a recess intended therefor, said recess being formed in the inside of said closet pan and extending about said closet pan in the vicinity of the upper boundary surface of said closet pan such that the terminal edges of said semilunar profile abut against the inside of said closet pan and, together with it, define said flushing channel.

4. An apparatus as claimed in claim 1, wherein said closet pan is provided with a flushing rim, said wall of elastic material being formed by a flange on said separate member, said wall closing the space between said flushing rim and the inner wall surface of said closet pan and being formed with recesses in its free edge surface, said recesses constituting discharge openings for the flushing liquid.

* * * * *